United States Patent [19]

Page et al.

[11] Patent Number: 4,891,285

[45] Date of Patent: Jan. 2, 1990

[54] IMAGED COPY FILM

[75] Inventors: Darrin J. Page, Wivenhoe; Stuart C. Rennison, Hadleigh, Nr Ipswich, both of England

[73] Assignee: Imperial Chemical Industries PLC, London, England

[21] Appl. No.: 265,503

[22] Filed: Nov. 1, 1988

[30] Foreign Application Priority Data

Nov. 3, 1987 [GB] United Kingdom ..... 8725673

[51] Int. Cl.[4] ..... G03G 7/00

[52] U.S. Cl. ..... 430/14; 430/17; 430/18; 430/126

[58] Field of Search ..... 430/13, 14, 17, 18, 430/126; 427/121

[56] References Cited

U.S. PATENT DOCUMENTS

| | | | |
|---|---|---|---|
| 3,854,942 | 12/1974 | Akman | 430/126 X |
| 4,259,422 | 3/1981 | Davidson et al. | 430/126 X |
| 4,526,847 | 7/1985 | Walker et al. | 430/17 X |
| 4,599,293 | 7/1986 | Eckell et al. | 430/126 |

*Primary Examiner*—Paul R. Michl
*Assistant Examiner*—Jeffrey A. Lindeman
*Attorney, Agent, or Firm*—Cushman, Darby & Cushman

[57] ABSTRACT

An imaged copy film comprising (a) a polymeric film substrate, (b) an image-receiving layer comprising a terpolymer of a vinyl halide, a vinyl ester of a saturated aliphatic carboxylic acid and a functional group-containing unsaturated termonomer, and (c) an electrostatic copying toner image layer. Toner adhesion is improved and the applied images exhibit superior resistance to abrasion and erasure.

10 Claims, No Drawings

IMAGED COPY FILM

This invention relates to an imaged copy film, and in particular to an electrostatically imaged copy film.

Transparencies for the projection of light images are known and can be formed from a transparent film base and an image or print applied thereto by an electrostatic copying process. Such applied images may lack permanence, in the sense that they exhibit inferior resistance to abrasio and erasure during repeated handling and use, unless special measures are taken to develoop adequate adhesion between the film base and the image layer. Similar problems are encountered with pigmented (white) or opaque copy or drafting films suitable for use in xerographic laser printer equipment or in wide format (841×1189 mm) copiers. This invention is concerned with improving the adhesion to a film base of an image layer derived from a copying toner powder and applied by an electrostatic copying process.

Accordingly, the present invention provides an imaged copy film comprising (a) a film substrate of a synthetic polymeric material having, on at least one surface thereof, (b) a receiving layer, and, on a surface of the receiving layer remote from the substrate, (c) an electrostatic copying toner image layer wherein the receiving layer comprises a terpolymer of (i) from 60 to 98 weight % of a vinyl halide, (ii) from 1 to 20 weight % of a vinyl ester of a saturated aliphatic carboxylic acid and the molecule of which contains from 2 to 6 carbon atoms, and (iii) from 1 to 20 weight % of a functional group-containing ethylenically-unsaturated termonomer.

The invention also provides a method of producing an imaged copy film comprising forming a receiving layer on at least one surface of a film substrate of a synthetic polymeric material and electrostatically applying to the receiving layer an image layer of a copying toner, wherein the receiving layer comprises a terpolymer of (i) from 60 to 98 weight % of a vinyl halide, (ii) from 1 to 20 weight % of a vinyl ester of a saturated aliphatic carboxylic acid the molecule of which contains from 2 to 6 carbon atoms, and (iii) from 1 to 20 weight % of a functional group-containing ethylenically-unsaturated termonomer.

The substrate may comprise any suitable polymeric material, in the form of a self supporting film or sheet. Suitable polymeric materials include cellulose esters, such as cellulose acetate, polystyrene, polyamides, polymers and copolymers of vinyl chloride, polymers and copolymers of olefins, eg polypropylene, polysulphones and particularly linear polyesters which may be obtained by condensing one or more dicarboxylic acids or their lower alkyl (1–5 carbon atoms) diesters, eg terephthalic acid, isophthalic acid, phthalic acid, 2,5-, 2,6- and 2,7-naphthalene dicarboxylic acid, succinic acid, sebacic acid, adipic acid, azelaic acid, diphenyl dicarboxylic acid, and hexahydroterephthalic acid or bis-p-carboxy phenoxy ethane, optionally with a mono-carboxylic acid, such as pivalic acid, with one or more glycols, eg ethylene glycol, 1,3-propanediol, 1,4-butanediol, neopentyl glycol and 1,4-cyclohexane-dimethanol. A biaxially oriented and heat-set film of polyethylene terephthalate is particularly useful for the production of a copy film according to the invention and may be produced by any of the processes known in the art, eg as described in British patent specification GB-A-838,708.

A substrate intended for use as a projection film should be transparent to permit relatively unrestricted transmission of light during image projection operations. However an opaque or pigmented polymeric substrate may be employed for plain paper copying operations. Thus, a substrate may be pigmented by the application of a pigmented coating layer on a surface thereof, or a substrate may be rendered opaque by incorporation into the film-forming synthetic polymer of an effective amount of an opacifying agent. In a further embodiment of the invention the opaque substrate is voided by incorporating into the polymer an effective amount of an agent which is capable of generating an opaque, voided substrate structure. Suitable voiding agents, which also confer opacity, include an incompatible resin, filler, a particulate inorganic filler or a mixture of two or more such fillers.

Particulate inorganic fillers suitable for generating an opaque, voided substrate include conventional inorganic pigments and fillers, and particularly metal or metalloid oxides, such as alumina, silica and titania, and alkaline earth metal salts, such as the carbonates and sulphates of calcium and barium. Barium sulphate is a particularly preferred filler which also functionas as a voiding agent.

Production of a substrate having satisfactory degrees of opacity, voiding and whiteness requires that the filler should be finely-divided, and the average particle size thereof is desirably from 0.1 to 10 microns (μm) provided that the actual particle size of 99.9% by number of the particles does not exceed 30 μm. Preferably, the filler has an average particle size of from 0.1 to 1.0 μm, and particulaly preferably from 0.2 to 0.75 μm.

The amount of filler, particularly of barium sulphate, incorporated into the substrate polymer desirably should be not less than 5% nor exceed 50% by weight, based on the weight of the polymer. Particularly satisfactory levels of opacity and gloss are achieved when the concentration of filler is from about 8 to 30%, and especially from 15 to 20%, by weight, based on the weight of the substrate polymer.

The thickness of the film substrate is suitably from 25 to 500, particularly from 50 to 300, and especially from 75 to 175 microns.

To promote adhesion of the receiving layer to the substrate, a surface of the latter may first be treated with a priming medium. Creation of a priming layer is conveniently effected by treating a surface of the polymeric substrate with an agent known in the art to have a solvent or swelling action on the substrate polymer. Examples of such agents, which are particularly suitable for the treatment of a polyester substrate, include a halogenated phenol such as p-chloro-m-cresol, 2,4-dichlorophenol, 2,4,5- or 2,4,6-trichlorophenol or 4-chlororesorcinol. The agent may be applied as a solution in a common organic solvent, such as acetone or methanol.

The primed substrate is conveniently dried by heating to a temperature of from 60° to 80° C. for from 1 to 5 hours.

Alternatively, or additionally an agent known to have a solvent or swelling action on the film substrate may be incorporated into the terpolymer resin for application therewith.

Adhesion of the receiving layer to the substrate may also be improved by first coating a surface of the substrate with a layer of an adhesive film-forming polymer resin. Particularly suitable resins include copolymers of acrylic acid and/or methacrylic acid and/or lower alkyl (up to 6 carbon atoms) esters thereof, such as—copolymers of ethyl acrylate and methyl methacrylate, copolymers of methyl methacrylate/butyl acrylate/acrylic acid typically in the molar proportions 55/27/18% and 36/24/40%, and especially copolymers containing hydrophilic functional groups, such as—copolymers of methyl methacrylate and methacrylic acid, and cross-linkable copolymers, particularly terpolymers comprising ethyl acrylate/methyl methacrylate/acrylamide or methacrylamide, conveniently in the approximate molar proportions 46/46/8% respectively. The latter polymer is particularly effective when thermoset—for example, in the presence of a cross-linking agent—such as a methoxylated melamine-formaldehyde resin, typically present in an amount of up to about 25% by weight of the terpolymer.

Formation of the adhesive layer may be effected by techniques known in the art, the layer being conveniently applied to the substrate, particularly as an inter-draw coating, from a coating composition comprising a solution or dispersion of the resin in a volatile medium, particularly an aqueous medium.

Adhesion of the image layer to the film substrate is promoted by the intermediate receiving layer which comprises a functional terpolymer. The vinyl halide component of the terpolymer conveniently comprises vinyl chloride, and the vinyl ester component conveniently comprises vinyl acetate.

Functionality in the termonomer component is conveniently conferred by the presence of hydroxyl group(s), and the hydroxyl group-containing ethylenically unsaturated termonomer suitably comprises a hydroxyl-containing alkyl acrylate or methacrylate, particularly a lower alkyl acrylate or methacrylate in which the alkyl group contains from 1 to 6 carbon atoms—especially a methyl, ethyl or propyl group.

Functionality may also be converred by the presence of a termonomer comprising a carboxylic acid or anhydride group, especially maleic acid or anhydride.

The functional group content of the terpolymer is relatively low, and when a hydroxyl-containing termonomer is present, the total hydroxyl content, based on the weight of the terpolymer, is desirably from 1.5 to 2.5 wt %, particularly from 1.8 to 2.2, eg 2.0 wt %. Similar concentrations of carboxylic acid or anhydride functional groups are of utility.

A preferred receiving layer comprises a terpolymer containing from 75 to 85 weight % of vinyl chloride, from 2 to 8 weight % of vinyl acetate and the balance (to 100 weight %) of an unsaturated functional termonomer (such as hydroxy-ethyl methacrylate).

The terpolymer resin is a relatively low molecular weight material, and the average molecular weight (number average) thereof is suitably within a range of from 1,000 to 100,000, more preferably from 4,000 to 16,000, and especially from 6,000 to 10,000.

The receiving layer may be of any appropriate thickness, but, for convenience, the dry coat thickness is suitably from 0.01 to 5 microns, and especially from 0.02 to 2 microns.

Formation of the receiving layer is conveniently effected by application to the film substrate of a receiving medium comprising a solution of the terpolymer in an organic solvent, such as acetone, methanol, diacetone alcohol or a mixture of two or more thereof. The solution conveniently comprises from 0.1 to 20%, and preferably from 0.5 to 5%, by weight of the terpolymer by volume of the solvent.

Application of the receiving medium to the film substrate may be effected by a conventional coating technique—for example, by a slot-, roller-, or bead-coating technique. The coating operation may be effected during or after production of the film substrate. Thus, in the production of a biaxially oriented film substrate by sequential stretching in two mutually perpendicular directions, the receiving medium may be applied before stretching commences, or between the two stages of the stretching operation. Alternatively, the medium may be applied to the biaxially oriented film on completion of the stretching operation.

Drying of the applied medium may be effected by a conventional drying technique—for example, by suspending the coated substrate for several (conveniently up to 10) minutes in a hot air oven maintained at an appropriate temperature. A drying temperature of from 70° to 130° C., preferably from 80° to 115° C., is usually suitable for a polyester substrate. Differential drying, at different temperatures, optionally for different durations, may be practised to control the rheology of the receiving layer.

An image layer may be formed on the receiving layer by a conventional electrostatic copying technique using a thermally fusible (thermoplastics) toner powder. Available toner powders include those based on styrene-acrylate copolymers, and blends thereof.

Electrostatic copying machines are well known and generally available for use in office copying operations. Such machines, particularly those which are commercially available under the registered trade mark "Xerox" may be used for the application of an image to a transparent film substrate in accordance with the invention. Machines of this nature generally operate by initially depositing a uniform positive electrostatic charge from a corona discharge electrode onto a drum having a photoconductive surface, eg a selenium coated drum, maintained in a dark environment. The charged surface is then exposed to a light image of the original document or representation to be copied, whereby the charge is dissipated and flows to earth from those areas of the drum struck by the light. The charge is not affected in the dark areas masked by the original document or representation. The image is then formed by passing negatively charged coloured thermoplastic toner powder over the light-exposed drum so that the powder is electrostatically attracted to the residual charged areas on the drum surface. The thus-formed toner powder image may be transferred to the film substrate of the invention by placing the receiving layer of the substrate over the toner image and positively charging the substrate by corona discharge so that the toner powder is attracted to the substrate by the residual negative charge on the toner powder. Finally the substrate may be heated to fuse the toner powder and bond it to the receiving layer surface of the film substrate as an image layer.

Thermal bonding of fusible toner powder to a film substrate is generally effected at relatively high fusion temperatures, for example—at about 200° C., in known electrostatic copying processes, and is commonly achieved by infra-red heating. However, somewhat lower temperatures, in the region of 120° C., applied by heated rollers or ultra-violet lamps, may also be used. It has been found that the adhesion of the toner powder to the film substrate in accordance with the invention is satisfactory at both high and low bonding temperatures.

A receiving layer may be provided on one or each surface of a film substrate, and an image may thus be generated on one or each receiving layer. The invention is of particular utility in the production of paper backed copying film where the non-image surface of the film substrate is laminated along one edge to a backing paper (usually of 40 to 100 gsm gauge) using an adhesive element, such as a thin longitudinal deposit of adhesive (pressure-sensitive or non pressure-sensitive) or tape. The presence of a paper layer in the laminated copy film assembly tends to inhibit transfer of heat to the receiving layer during the thermal bonding stage of the copying process, and therefore effectively impairs toner adhesion. The present receiving medium enables a satisfactorily high level of toner adhesion to be achieved even when a paper backing layer is employed in association with a copying film in accordance with the invention.

When multiple copies are to be produced in a high speed electrostatic copying machine, a finely divided particulate material, such as silica particles, may be incorporated as an anti-blocking agent into the receiving medium. If desired, an antistatic coating medium may be applied to the surface of the film support remote from the image receiving layer. The static friction of the film base can be reduced by applying a wax—for example a natural wax, such as carnauba wax, or a synthetic wax, to one or both surfaces of the film support, the wax coating on that surface carrying the receiving layer being applied over that layer. These precautions facilitate the feeding of single sheets froma stack of sheets in a high speed copying machine.

The presence of an anti-friction medium, such as wax, on the receiving layer is particularly desirable in the case of paper backed laminate copy sheets to be fed in succession from a stack of sheets. Thus, in a stack feed assembly, the image surface of one copy laminate sheet is in contact, in the supply magazine, with the surface of the paper backing sheet of an adjacent copy laminate, and the frictional characteristics of these relatively incompatible surfaces must be controlled so that one laminate slides readily over the other when fed to the copier by the usual belt or suction mechanism. Surprisingly, we have observed that the presence of a wax on the receiving layer does not significantly impair the toner adhesion characteristics of the specified terpolymer medium.

The invention is illustrated by reference to the following Examples.

EXAMPLES 1a–1g

A conventional transparent 100 micron thick biaxially oriented and heat set film of polyethylene terephthalate was pretreated by bead coating on one surface with a solution of 2 g p-chloro-m-cresol in 100 ml of methanol to yield a wet coat weight of 100 mg/dm$^2$. The pretreated surface was dried by heating in an air oven for 2 minutes at 80° C.

The pretreated surface was then bead coated with a solution of 1 g of a terpolymer of vinyl chloride (81 wt %), vinyl acetate (4 wt %) and a hydroxyl-containing propyl acrylate (15 wt %) with a total hydroxyl content of 2.0% by weight of the terpolymer, and an average molecular weight (number average) of 8,000, in a solvent mixture of 81 ml acetone, 14 ml methanol and 5 ml diacetone alcohol to yield a wet coat weight of 100 mg/dm$^2$. The coating was dried by heating in an air oven at 80° C. for 3 minutes and then at 115° C. for 2 minutes to yield a receiving layer having a dry thickness of about 0.2 micron.

A solution of 0.10 g of 'Pluriol' E9000 wax in 100 ml methanol was then applied to the dried receiving layer, and the wax coating was dried in an air oven at 90° C. for 2 minutes.

The waxed film was cut into A4 sheets and to the non-image surface of each sheet was laminated an A4 sheet of white paper (70 gsm Garnett Poster Paper) by means of a thin layer of pressure sensitive adhesive along one long edge, to yield a paperbacked composite.

Respective composite sheets were imaged in a variety of plain paper copiers, using conventional "Xerox" thermoplastics toner powder, operated at the specification pre-set powder fusin temperature.

Parallel control experiments were performed using similar composite sheets—identical to those of the invention save that the receiving layer comprised a copolymer of n-butyl methacrylate and methyl methacrylate (70:30 molar) of the kind disclosed in the specification of British patent GB-A-1447272.

The respective imaged sheets were assessed by two tests:

(1) by scraping the image layer with a finger nail and (2) by crease folding the image layer.

Results are recorded in the accompanying Table, and show that adhesion of the image to the copy film formed according to the invention was good, and better than that of control films formed in accordance with GB-A-1447272.

TABLE

| | | Toner Adhesion | |
|---|---|---|---|
| Example | Copier Type | Nail/Scratch* | Crease/Fold (mm)** |
| 1a | XEROX 1045 | f | 1.0 |
| Control | XEROX 1045 | s | 3.0 |
| 1b | XEROX 1048 | m/g | 0.5 |
| Control | XEROX 1048 | s/f | 1.5 |
| 1c | XEROX 1075 | f/m | 1.0 |
| Control | XEROX 1075 | s/f | 1.0 |
| 1d | XEROX 2830 | f | 1.0 |
| Control | XEROX 2830 | s | 1.5 |
| 1e | XEROX CBA 9400 | g | 1.0 |
| Control | XEROX CBA 9400 | g | 1.5 |
| 1f | XEROX CBA 9500 | m/g | 1.0 |
| Control | XEROX CBA 9500 | p | 2.5 |
| 1g | CANON NP 300 | m/g | <0.5 |
| Control | | m | <0.5 |

*Toner adhesion: g = good, m = moderate, f = fair, s = slight, p = poor

**To effect the crease/fold test a square sample (10 × 10 mm) of the imaged film, after cooling to ambient temperature, was placed on a flat support with the imaged surface uppermost and sharply folded along a diagonal. The sample was then unfolded and gently wiped with a paper tissue along the resultant diagonal crease line to remove loose toner powder. With the aid of an optical magnifier, the width of the zone from which toner had been removed was measured perpendicular to, and at several locations along, the crease line. The average of these width measurements is the measurement recorded in the Table.

EXAMPLE 2

The procedure of Example 1 was repeated save that (a) the terpolymer receiving medium, and associated wax layer, was applied to both surfaces of the polyethylene terephthalate supporting film, and (b) the copy film was not provided with a paper backing layer. Parallel control films having both surfaces coated with the n-butyl methacrylate—methyl methacrylate copolymer were prepared.

After imaging ina XEROX 1048 plain paper copier, the films according to the invention were shown to exhibit superior toner adhesion relative to the control films, when assessed by the aforementioned tests.

EXAMPLE 3

The procedure of Example 1 was repeated save that the terpolymer was applied at a concentration to yield a receiving layer having a dry thickness of about 0.4 μm.

Imaged sheets, prepared as in Example 1, again exhibited superior toner adhesion relative to comparable control films.

EXAMPLE 4

The procedure of Example 1 was repeated save that the terpolymer was applied at a concentration to yield a receiving layer having a dry thickness of about 0.6 μm.

Imaged sheets, prepared as in Example 1 again exhibited superior toner adhesion relative to comparable control films.

EXAMPLE 5

The procedure of Example 1 was repeated save that the terpolymer (vinylchloride/vinyl acetate/hydroxylated propyl acrylate:81/41/15), which was applied to yield a receiving layer having a dry thickness of about 0.2 μm, had an average molecular weight (number average) of about 4,000.

Imaged sheets prepared as in Example 1, exhibited improved toner adhesion of the same order as that of the products of that Example.

EXAMPLE 6

The procedure of Example 1 was repeated save that the terpolymer which was applied to yield a receiving layer having a dry thickness of about 0.2 μm comprised vinyl chloride, vinyl acetate and maleic acid in a weight ratio of 81:17:2.

Films imaged in accordance with Example 1 again exhibited superior toner adhesion relative to control films according to GB-A-1447272.

EXAMPLE 7

The procedure of Example 1 was repeated save that the base film comprised a biaxially oriented and heat-set film of polyethylene terephthalate of 125 μm thickness having on one surface thereof a layer of a thermoset acrylic resin comprising methyl methacrylate/ethylacrylate/methacrylamide ina molar ratio of 46:46:8 and containing 25 mole % of methoxylated melamine formaldehyde, the thermoset resin having been applied from an aqueous latex between the longitudinal and transverse film drawing stages and dried to yield a thermoset coating of about 0.03 μm thickness.

The terpolymer coating medium of Example 1 was applied directly to the acrylic surface of the film without prior treatment with a swelling agent, and when tested by the procedure of Example 1 was observed to exhibit excellent adhesion and abrasion-resistance.

EXAMPLE 8

The procedure of Example 1 was repeated save that the base film comprised an opaque, voided biaxially oriented film of polyethylene terephthalate containing 18% by weight of a finely-divided particulate barium sulphate filler having an average particle size of 0.5 μm.

When tested by the procedure of Example 1 the applied terpolymer coating was again observed to exhibit excellent adhesion and abrasion-resistance.

What is claimed is:

1. An imaged copy film comprising
(a) a film substrate of a synthetic polymeric material having, on at least one surface thereof,
(b) a receiving layer, and, on a surface of the receiving layer remote from the substrate,
(c) an electrostatic copying toner image layer, wherein the receiving layer comprises a terpolymer of
(i) from 60 to 98 weight % of a vinyl halide,
(ii) from 1 to 20 weight % of a vinyl ester of a saturated aliphatic carboxylic acid the molecule of which contains from 2 to 6 carbon atoms, and
(iii) from 1 to 20 weight % of a functional group-containing ethylenically-unsaturated termonomer.

2. A copy film according to claim 1 comprising a receiving layer on each surface of the film substrate.

3. A copy film according to claim 1 comprising a backing paper bonded to a non-imaged surface of the film substrate.

4. A copy film according to claim 1 comprising a wax layer on the, or each, receiving layer.

5. A copy film according to claim 1 comprising a finely-divided particulate material in the, or each, receiving layer.

6. A copy film according to claim 1 wherein the receiving layer comprises (i) vinyl chloride, (ii) vinyl acetate and (iii) a hydroxyl-containing alkyl acrylate or alkyl methacrylate in which the alkyl group contains frm 1 to 6 carbon atoms.

7. A copy film according to claim 6 wherein the hydroxyl content of the terpolymer is from 1.5 to 2.5% by weight thereof.

8. A copy film according to claim 6 wherein the terpolymer comprises from 75 to 85% by weight of vinyl chloride, from 2 to 8% by weight of vinyl acetate, and the balance (to 100% by weight) of a hydroxy-alkyl acrylate or methacrylate.

9. A copy film according to claim 1 wherein the substrate comprises a biaxially oriented film of polyethylene terephthalate.

10. A method of producing an imaged copy film comprising forming a receiving layer on at least one surface of a film substrate of a synthetic polymeric material and electrostatically applying to the receiving layer an image layer of a copying toner, wherein the receiving layer comprises a terpolymer of
(i) from 60 to 98 weight % of a vinyl halide,
(ii) from 1 to 20 weight % of a vinyl ester of a saturated aliphatic carboxylic acid the molecule of which contains from 2 to 6 carbon atoms, and
(iii) from 1 to 20 weight % of a functional group-containing ethylenically-unsaturated termonomer.

* * * * *